US006471566B1

(12) United States Patent
Mikhaylich et al.

(10) Patent No.: US 6,471,566 B1
(45) Date of Patent: Oct. 29, 2002

(54) SACRIFICIAL RETAINING RING CMP SYSTEM AND METHODS FOR IMPLEMENTING THE SAME

(75) Inventors: Katrina A. Mikhaylich, San Jose; John M. Boyd, Atascadero, both of CA (US)

(73) Assignee: Lam Research Corporation, Fremont, CA (US)

( * ) Notice: Subject to any disclaimer, the term of this patent is extended or adjusted under 35 U.S.C. 154(b) by 29 days.

(21) Appl. No.: 09/664,609

(22) Filed: Sep. 18, 2000

(51) Int. Cl.[7] ..... B24B 1/00

(52) U.S. Cl. ..... 451/41; 451/286; 451/287; 451/60

(58) Field of Search ..... 451/41, 285, 286, 451/287, 288, 289, 303, 307, 60

(56) References Cited

U.S. PATENT DOCUMENTS

| | | | | |
|---|---|---|---|---|
| 3,254,454 | A | 6/1966 | Cetrangolo | 51/56 |
| 3,564,776 | A | 2/1971 | Aspden | 51/55 |
| 3,589,078 | A | 6/1971 | Bala et al. | 51/165 |
| 3,874,123 | A | 4/1975 | Hopkins et al. | 51/120 |
| 3,979,239 | A | 9/1976 | Walsh | 156/4 |
| 4,128,968 | A | 12/1978 | Jones | 51/54 |
| 4,144,099 | A | 3/1979 | Edmonds et al. | 148/1.5 |
| 4,197,676 | A | 4/1980 | Sauerland | 51/118 |
| 4,232,485 | A | 11/1980 | Eadon-Allen | 51/55 |
| 4,244,775 | A | 1/1981 | D'Asaro | 156/636 |
| 4,358,338 | A | 11/1982 | Downey et al. | 156/627 |
| 4,403,453 | A | 9/1983 | Cave et al. | 51/124 R |
| 4,419,848 | A | 12/1983 | Dischert | 51/229 |
| 4,462,860 | A | 7/1984 | Szmanda | 156/626 |
| 4,600,469 | A | 7/1986 | Fusco et al. | 156/636 |
| 4,671,851 | A | 6/1987 | Beyer et al. | 156/645 |
| 4,693,036 | A | 9/1987 | Mori | 51/131.3 |
| 4,789,648 | A | 12/1988 | Chow et al. | 437/225 |
| 4,793,895 | A | 12/1988 | Kaanta et al. | 156/627 |
| 4,879,258 | A | 11/1989 | Fisher | 437/225 |

(List continued on next page.)

FOREIGN PATENT DOCUMENTS

| | | | |
|---|---|---|---|
| EP | 0 150 074 B1 | 7/1985 | B34B/27/00 |
| EP | 0 150 074 A2 | 7/1985 | B24B/27/00 |
| EP | 0 180 175 A2 | 5/1986 | B24B/7/16 |
| EP | 0223920 A2 | 7/1986 | H01L/21/306 |
| EP | 0 223 920 B1 | 7/1986 | H01L/21/306 |
| EP | 0 272 531 A1 | 6/1988 | B24B/7/16 |
| EP | 0 272 531 B1 | 6/1988 | B24B/7/16 |
| GB | 2324 750 A | 4/1998 | B24B/37/04 |
| JP | 53-68493 | 6/1978 | B24B/37/00 |
| JP | 56-140632 | 11/1981 | H01L/21/322 |
| JP | WO 82/03038 | 9/1982 | B24B/37/04 |
| JP | 57-170538 | 10/1982 | H01L/21/304 |
| JP | 7-45565 | 2/1995 | H01L/21/304 |
| JP | 7-111256 | 4/1995 | H01L/21/304 |
| JP | 7-266220 | 10/1995 | H01L/21/304 |
| JP | H11-156711 | 6/1999 | H01L/21/304 |
| WO | WO 97/40525 | 10/1997 | H01L/21/00 |

*Primary Examiner*—Eileen P. Morgan
*Assistant Examiner*—Hadi Shakeri
(74) *Attorney, Agent, or Firm*—Martine & Penilla, LLP

(57) ABSTRACT

A retaining ring structure of a carrier head designed for use in a chemical mechanical polishing system (CMP) is provided. The retaining ring includes a retaining ring support and a sacrificial retaining ring, which is designed to confine a substrate to be polished. The included sacrificial retaining ring has an upper surface and a contact surface. The upper surface of the sacrificial retaining ring is configured to be attached to the retaining ring support, such that the retaining ring support holds the sacrificial retaining ring. Preferably, the contact surface of the sacrificial retaining ring is configured to be substantially planer with a top surface of the substrate being polished. In a preferred example, the sacrificial retaining ring can include a plurality of capillary tubes and is constructed from a material having substantially the same characteristics as the surface of the substrate to be polished.

28 Claims, 6 Drawing Sheets

U.S. PATENT DOCUMENTS 4,956,944 A 9/1990 Ando et al. ..... 51/165.71
5,104,421 A 4/1992 Takizawa et al. ..... 51/295
5,287,663 A 2/1994 Pierce et al. ..... 51/401
5,508,077 A 4/1996 Chen et al. ..... 428/64.3
5,527,423 A 6/1996 Neville et al. ..... 156/636.1
5,542,874 A 8/1996 Chikaki ..... 451/158
5,547,417 A 8/1996 Breivogel et al. ..... 451/58
5,599,423 A 2/1997 Parker et al. ..... 156/636.1
5,635,083 A * 6/1997 Breivogel et al. ..... 451/289
5,665,201 A 9/1997 Sahota ..... 438/693
5,672,095 A 9/1997 Morimoto et al. ..... 451/41
5,851,136 A * 12/1998 Lee ..... 451/288
5,888,120 A 3/1999 Doran ..... 451/41
5,919,082 A 7/1999 Walker et al. ..... 451/41
5,957,763 A 9/1999 Anderson, III et al. ..... 451/262
5,958,148 A 9/1999 Holzapfel et al. ..... 134/18
5,961,369 A 10/1999 Bartels et al. ..... 451/5
5,969,521 A 10/1999 Kurita et al. ..... 324/229
5,972,162 A 10/1999 Cesna ..... 156/345
5,974,681 A 11/1999 Gonzalez-Martin et al. ... 34/58
5,975,094 A 11/1999 Shurtliff ..... 134/1.3
5,975,986 A 11/1999 Allen et al. ..... 451/5
5,975,991 A 11/1999 Karlsrud ..... 451/41
5,980,366 A 11/1999 Waddle et al. ..... 451/262
5,980,769 A 11/1999 Yanagisawa et al. ..... 216/67
5,985,094 A 11/1999 Mosca ..... 156/345
5,989,104 A 11/1999 Kim et al. ..... 451/41
5,993,289 A 11/1999 Allen et al. ..... 451/5
5,993,302 A 11/1999 Chen et al. ..... 451/285
5,997,390 A 12/1999 Hosé ..... 451/262
6,001,005 A 12/1999 Anderson, III et al. ..... 451/268
6,012,964 A 1/2000 Arai et al. ..... 451/5
6,022,807 A 2/2000 Lindsey, Jr. et al. ..... 438/693
6,030,280 A 2/2000 Fruitman ..... 451/291
6,030,488 A 2/2000 Izumi et al. ..... 156/345
6,033,521 A 3/2000 Allen et al. ..... 156/345
6,038,082 A 3/2000 Takatsuki ..... 359/688
6,039,638 A 3/2000 Nagayama et al. ..... 451/288
6,040,244 A 3/2000 Arai et al. ..... 438/691
6,041,465 A * 3/2000 Yashiki et al. ..... 15/88.3
6,045,431 A * 4/2000 Cheprasov et al. ..... 451/5
6,048,259 A * 4/2000 Asai ..... 451/339
6,056,632 A * 5/2000 Mitchel et al. ..... 451/288
6,058,950 A * 5/2000 Fujii et al. ..... 134/182
6,062,949 A * 5/2000 Yashiki et al. ..... 451/10
6,062,954 A * 5/2000 Izumi ..... 451/72
6,066,230 A * 5/2000 Arai ..... 156/345
6,068,545 A * 5/2000 Arai ..... 451/288
6,068,548 A * 5/2000 Vote et al. ..... 451/287
6,074,275 A 6/2000 Yashiki et al. ..... 451/5
6,074,277 A * 6/2000 Arai ..... 451/8
6,083,089 A * 7/2000 Breivogel et al. ..... 451/287
6,089,961 A * 7/2000 Cesna et al. ..... 451/285
6,093,087 A 7/2000 Hakomori et al. ..... 451/57
6,095,900 A 8/2000 Fruitman et al. ..... 451/28
6,095,908 A * 8/2000 Torii ..... 451/285
6,102,779 A 8/2000 Cesna et al. ..... 451/41
6,102,784 A 8/2000 Lichner ..... 451/262
6,106,379 A 8/2000 Mosca ..... 451/288
6,106,662 A 8/2000 Bibby, Jr. et al. ..... 156/345
6,110,026 A 8/2000 Arai ..... 451/289
6,113,465 A 9/2000 Kim et al. ..... 451/41
6,113,468 A 9/2000 Natalicio ..... 451/41
6,113,478 A 9/2000 Anderson, III et al. ..... 451/262
6,206,758 B1 * 3/2001 Lai et al. ..... 451/287
6,244,945 B1 * 6/2001 Weldon et al. ..... 451/307
6,245,193 B1 * 6/2001 Quek et al. ..... 451/288
6,264,789 B1 * 7/2001 Pandey et al. ..... 451/307
6,271,140 B1 * 8/2001 Chang ..... 451/288
6,277,014 B1 * 8/2001 Chen et al. ..... 451/287
6,290,584 B1 * 9/2001 Kim et al. ..... 451/288
6,179,694 B1 * 1/2002 Quek ..... 451/288

* cited by examiner

SACRIFICIAL RETAINING RING CMP SYSTEM AND METHODS FOR IMPLEMENTING THE SAME

BACKGROUND OF THE INVENTION

1. Field of the Invention

The present invention relates generally to chemical mechanical polishing (CMP) systems and techniques for improving the performance and effectiveness of CMP operations. Specifically, the present invention relates to a substrate carrier having an active sacrificial retaining ring.

2. Description of the Related Art

In the fabrication of semiconductor devices, there is a need to perform CMP operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. At each metallization level and/or associated dielectric layer, there is a need to planarize the metal and/or dielectric material. Without planarization, fabrication of additional metallization layers becomes substantially more difficult due to the higher variations in the surface topography. In other applications, metallization line patterns are formed in the dielectric material, and then metal CMP operations are performed to remove excess metallization.

In the prior art, CMP systems typically implement belt, orbital, or brush stations in which belts, pads, or brushes are used to polish, buff, and scrub one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

In a typical CMP system, a wafer is mounted on a carrier, which rotates in a direction of rotation. The CMP process is achieved when the exposed surface of the rotating wafer is applied with force against a polishing pad, which moves or rotates in a polishing pad direction. Some CMP processes require that a significant force be used at the time the rotating wafer is being polished by the polishing pad.

Normally, the polishing pads used in the CMP systems are composed of porous or fibrous materials. Depending on the type of the polishing pad used, slurry composed of an aqueous solution containing different types of dispersed abrasive particles such as $SiO_2$ and/or $Al_2O_3$ may be applied to the polishing pad, thereby creating an abrasive chemical solution between the polishing pad and the wafer.

FIG. 1A depicts a cross-sectional view of an exemplary prior art CMP system. The CMP system of FIG. 1A depicts a carrier head 100 engaging a wafer 102 utilizing a retaining ring 101. The carrier head 100 is applied against the polishing pad surface 103*a* of a polishing pad 103 with a force F. As shown, the top surface of the retaining ring 101 is positioned above the front surface of the wafer 102. Thus, while the front surface of the wafer 102 is in contact with the polishing pad surface 103*a*, the surface of the retaining ring 101 is configured not to come into contact with the polishing pad surface 103*a*.

Several problems may be encountered while using a typical prior art CMP system. One recurring problem is called "edge-effect" caused by the CMP system polishing the edge of the wafer 102 at a different rate than other regions, thereby creating a non-uniform profile on the surface of the wafer 102. The problems associated with edge-effect can be divided into two distinct categories of the "pad rebound effect" and "edge burn-off effect." FIG. 1B is an enlarged illustration of the pad rebound effect associated with the prior art. The pad rebound effect occurs when the polishing pad surface 103*a* initially comes into contact with the edge of the wafer 102 causing the polishing pad surface 103 to bounce off the wafer 102. As the moving polishing pad surface 103*a* shifts under the surface of the wafer 102, the edge of the wafer 102 cuts into the polishing pad 103 at the edge contact zone 104*c*, causing the polishing pad 103*a* to bounce off the wafer 102, thereby creating a wave on the polishing pad 103.

Ideally, the polishing pad 103 is configured to be applied to the wafer 102 at a specific uniform pressure. However, the waves created on the polishing pad 103 create a series of low-pressure regions such as an edge non-contact zone 104*a* and a non-contact zone 104*a*, wherein the removal rate is lower than the average removal rate. Thus, the regions of the wafer 102 which came into contact with the polishing pad surface 103*a* such as the edge contact zone 104*c* and a contact zone 104*b*, are polished more than the other regions. As a result, the CMP processed wafer will tend to show a non-uniform profile.

Further illustrated in FIG. 1B is the edge "burn-off." As the polishing pad surface 103*a* comes into contact with the sharper edge of the wafer 102 at the edge contact zone 104*c*, the edge of the wafer 102 cuts into the polishing pad 103, thereby creating an area defined as a "hot spot," wherein the pressure exerted by the polishing pad 103 is higher than the average polishing pressure. Thus, the polishing pad surface 103*a* excessively polishes the edge of the wafer 102 and the area around the edge contact zone 104 (i.e., the hot spots). The excessive polishing of the edge of the wafer 102 occurs because a considerable amount of pressure is exerted on the edge of the wafer 102 as a result of the polishing pad surface 103*a* applying pressure on a small contact area defined as the edge contact zone 104*c*. As a consequence of the burn-off effect, a substantially high removal rate is exhibited at the area within about 1 millimeter to about 3 millimeters of the edge of the wafer 102. Moreover, depending on the polisher and the hardware construction, a substantially low removal rate is detected within the edge non-contact zone 104*a*', an area between about 3 millimeters to about 20 millimeters of the edge of the wafer 102. Accordingly, as a cumulative result of the edge-effects, an area of about 1 millimeter to about 20 millimeters of the edge of the resulting post CMP wafers sometimes could be rendered unusable, thereby wasting silicon device area.

Although, occasionally, an air bearing has been implemented in an attempt to compensate for the different levels of pressure applied by the polishing pad 103, air bearings have almost never been able to completely compensate for the difference in the pressure levels. Particularly, at the edge contact zone 104*c*, the edge non-contact zone 104*a*', the contact zone 104*b*, and the non-contact zone 104*a* the use of air bearings do not completely compensate for the difference in the exerted pressure, as the air can easily escape.

A common problem associated with the pad rebound effect and the edge burn off effect is the non-uniformity of the wafer 102 caused by the lack of uniform distribution of slurry between the polishing pad surface 103*a* and the surface of the wafer 102. As the edge of the wafer 102 cuts into the polishing pad surface 103*a*, it causes the slurry to be squeezed out of the polishing pad 103, thereby preventing the polishing pad surface 103*a* from performing a thorough polishing operation on the edge of the wafer 102. Thus, to accomplish a proper polishing operation, additional slurry must be supplied to the polishing interface. Consequently, a significant amount of slurry is wasted as a result of the combined effects of the pad rebound effect and edge burn-off effect.

In view of the foregoing, a need therefore exists in the art for a chemical mechanical polishing system that substantially eliminates damaging edge-effects and their associated removal rate non-uniformities while efficiently facilitates slurry distribution.

SUMMARY OF THE INVENTION

Broadly speaking, the present invention fills these needs by providing a system, which yields a substantially uniform removal rate throughout the surface of a wafer. In a preferred embodiment, the CMP system is designed to implement an active retaining ring configured to have a sacrificial component, which simulates the pattern of the substrate being polished by utilizing a plurality of collimated holes. As the sacrificial component is being polished together with the wafer, the edge of the polishing interface is thus virtually extended to the outside of the substrate being polished, thereby eliminating the aforementioned edge-effects, pad rebound effects, and edge bum-off effects. It should be appreciated that the present invention can be implemented in numerous ways, including as a process, an apparatus, a system, a device, or a method. Several inventive embodiments of the present invention are described below.

In one embodiment, a retaining ring structure of a carrier head for use in a chemical mechanical polishing system (CMP) is disclosed. The retaining ring structure includes a retaining ring support and a sacrificial retaining ring designed to confine a substrate to be polished. The sacrificial retaining ring also has an upper surface and a contact surface. The upper surface of the sacrificial retaining ring is configured to be attached to the retaining ring support, such that the retaining ring support holds the sacrificial retaining ring. The contact surface of the sacrificial retaining ring is configured to be substantially planer with a top surface of the substrate being polished.

In another embodiment, a wafer holding and application apparatus for use in chemical mechanical polishing (CMP) applications is disclosed. The apparatus includes a carrier head and a retaining ring support, which is designed to be attached to the carrier head. Also included in the apparatus is a sacrificial retaining ring, which is attached to the retaining ring support. The sacrificial retaining ring is designed to confine a wafer at a desired location when the carrier head applies the wafer to a polishing surface. The retaining ring support is defined from a material that approximates the wafer. A contact surface of the sacrificial retaining ring is positioned approximately planar with a to be polished surface of the wafer.

In yet another embodiment, a method for making a carrier head to be used in chemical mechanical polishing (CMP) of a wafer is disclosed. The method includes generating a retaining ring support and attaching the retaining ring support to the carrier head. Also included in the method is generating a plurality of capillary tube array units each having a contact surface. The method further includes attaching each of the plurality of capillary tube array units around the retaining ring support such that the plurality of capillary tube array units define a sacrificial retaining ring designed to contain the wafer having a surface to be polished. In addition, the surface of the wafer to be polished and the contact surface of each of the plurality of capillary tube array units are defined at about a same planar position.

The advantages of the present invention are numerous. Primarily, in contrast to prior art CMP systems, the contact surface of the sacrificial retaining ring is positioned substantially on a same horizontal plane as the top surface of the wafer, thereby virtually extending the polishing interface to the outside of the surface of the wafer. As such, the present invention eliminates the negative effects of the edge-effects, pad rebound effects, and edge burn-off effect. In addition, the construction of the sacrificial retaining ring out of plurality of capillary tube array units having plurality of capillary tubes facilitates the uniform distribution of slurry to the polishing interface so as to achieve a substantially uniform material removal through out the surface of the wafer.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

FIG. 3B-2 is an enlarged cross-sectional view of a polishing pad surface being applied to a wafer and a sacrificial retaining ring utilizing a slurry guide inlet to supply additional slurry to the sacrificial retaining ring via a slurry distribution manifold, in accordance with yet another embodiment of the present invention.

DETAILED DESCRIPTION OF THE PREFERRED EMBODIMENTS

An invention for a CMP system, which substantially eliminates the aforementioned edge-effects, pad rebound effects, and edge burn-off effects is disclosed. In preferred embodiments, the CMP system implements an active retaining ring having a sacrificial component, which simulates the patterned surface of the wafer while relocating the line of contact of the polishing pad and the wafer, outside of the wafer surface and onto the outer edge of the sacrificial component of the retaining ring. Preferably, in one implementation, the sacrificial component is constructed from glass (e.g., Silicon dioxide ($SiO_2$), Borosilicate, Soda Lime, etc.) and contains a plurality of capillary tubes, which assist in simulating the patterns on the surface of the wafer and/or facilitate uniform distribution of slurry to the polishing interface.

In the following description, numerous specific details are set forth in order to provide a thorough understanding of the present invention. It will be understood, however, to one skilled in the art, that the present invention may be practiced without some or all of these details. In other instances, well known process operations have not been described in detail in order not to unnecessarily obscure the present invention.

Figure 1A:
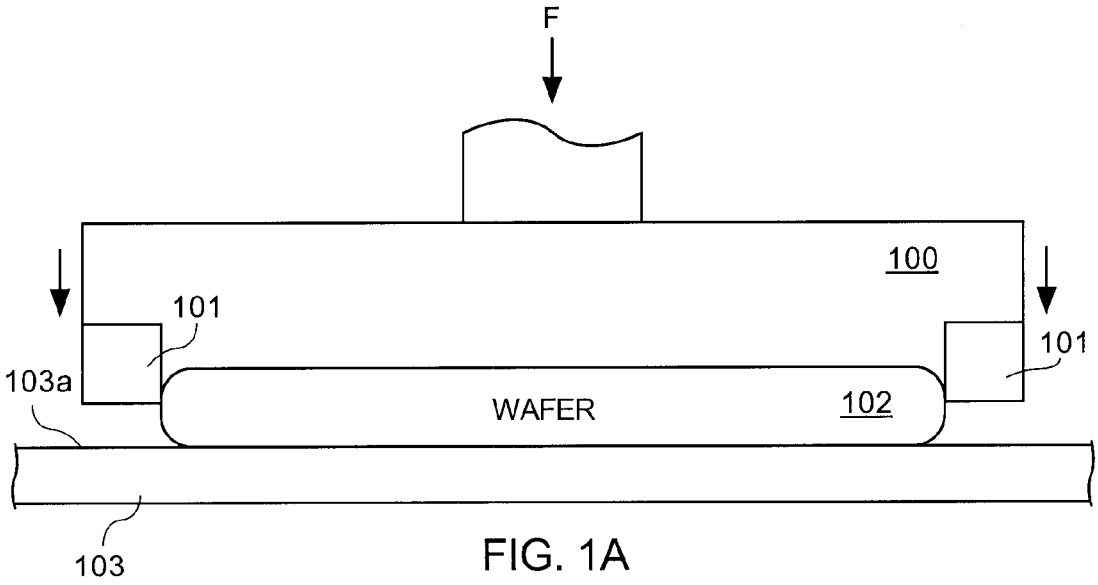
FIG. 1A (prior art)
FIG. 1A is an illustration of the prior art CMP system.
Figure 1B:
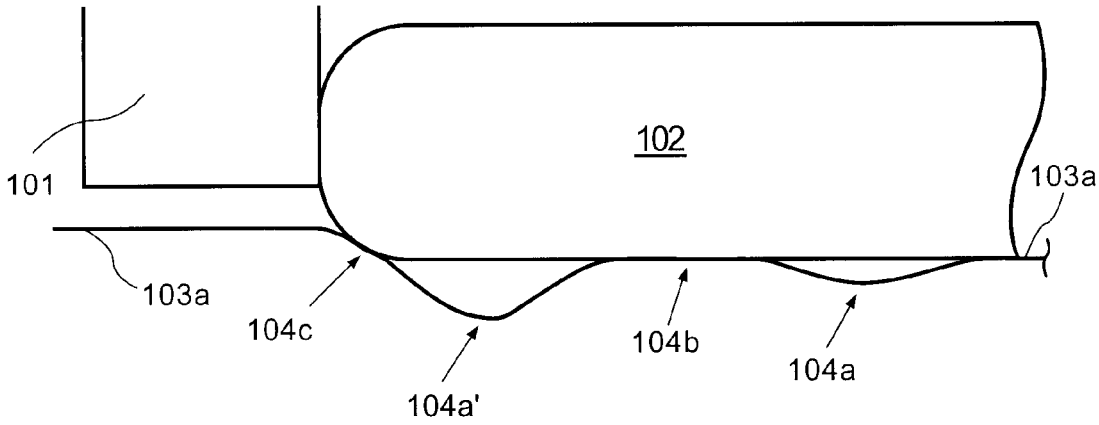
FIG. 1B (prior art)
FIG. 1B is an illustration of the pad rebound effect and edge burn-off effect associated with the prior art.
Figure 2:
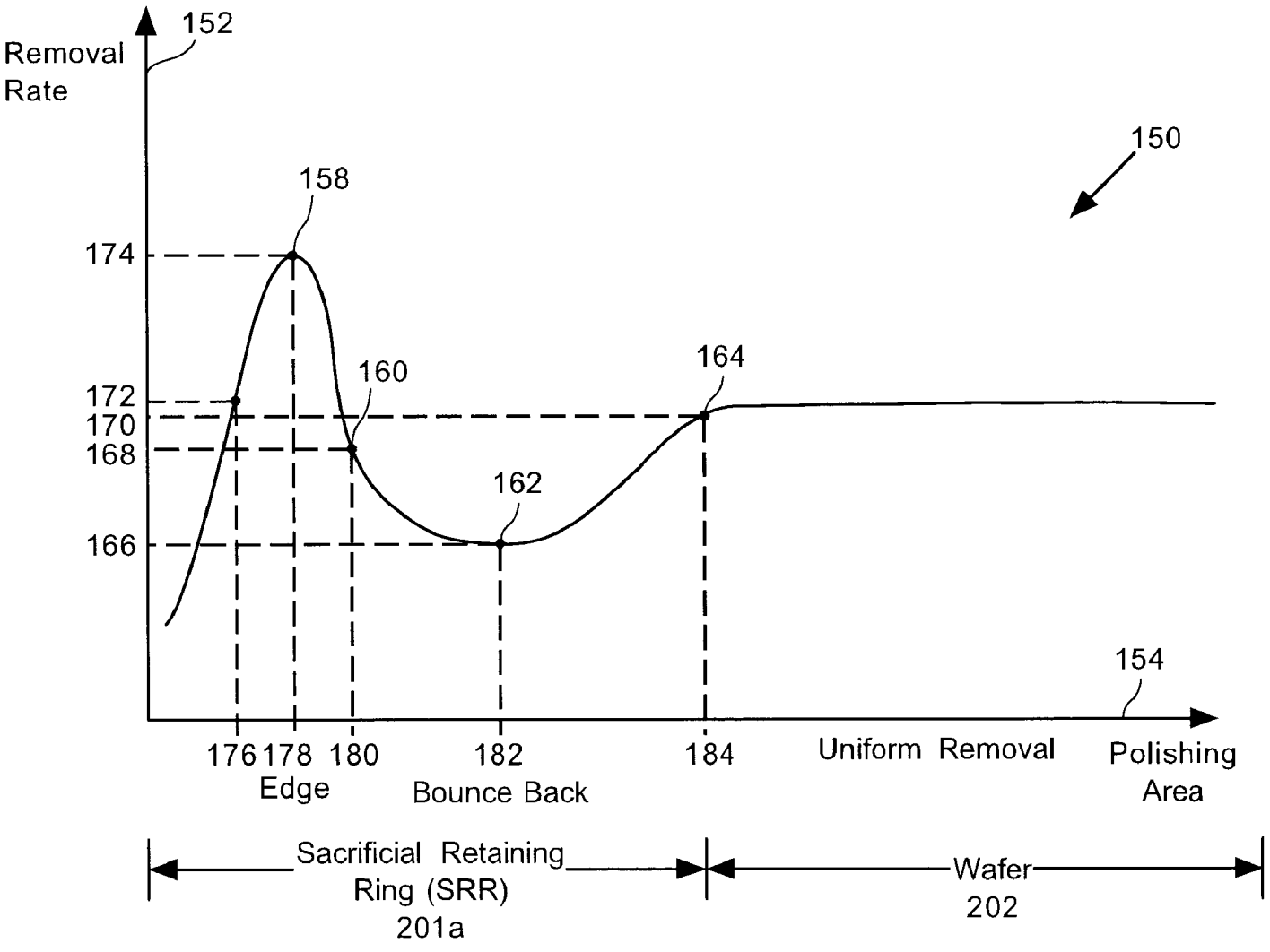
FIG. 2 depicts the non-uniform removal rate of materials from a polishing interface, in accordance with one embodiment of the present invention.

Graph 150 of FIG. 2 depicts the non-uniform removal rate of materials from a polishing interface, in accordance with the present invention. A removal rate axis 152 of the graph 150 illustrates the fluctuation of the removal rates of materials at different points of the polishing area axis 154. In accordance with one embodiment of the present invention, the CMP system starts the polishing operation at an edge of a sacrificial retaining ring (SRR) 176 so as to achieve a removal rate of 172. Thereafter, as a result of the edge-effect, pad rebound effect, and burn-off effect, a maximum removal rate 174 is achieved at a point 158, which corresponds to a point 178 located on the Sacrificial Retaining Ring (SRR) 201*a*. Then, the graph descends, depicting a point 160, which corresponds to the CMP machine polishing a point 180 located on the SRR 201*a* having a removal rate of 168. Subsequently, a substantially lower removal rate of 166 is achieved for the point 182 positioned within the bounce back region of the polishing area axis 154 still located within the SRR 201*a* corresponding to a point 162 of the graph. Then, at a point 164 of the graph, a substantially uniform removal rate of 170 is achieved. As depicted, the point 164 corresponds to a position 184 of the polishing area axis, representing approximately the end of the SRR 201*a* and approximately the beginning of the true edge of a wafer 202. Thus, as illustrated, the non-uniform removal rate caused by the edge-effect, pad rebound effect, and edge burn-off effect has been substantially eliminated by virtually extending the edge of the polishing interface to outside of the wafer 202.

Figure 3A:
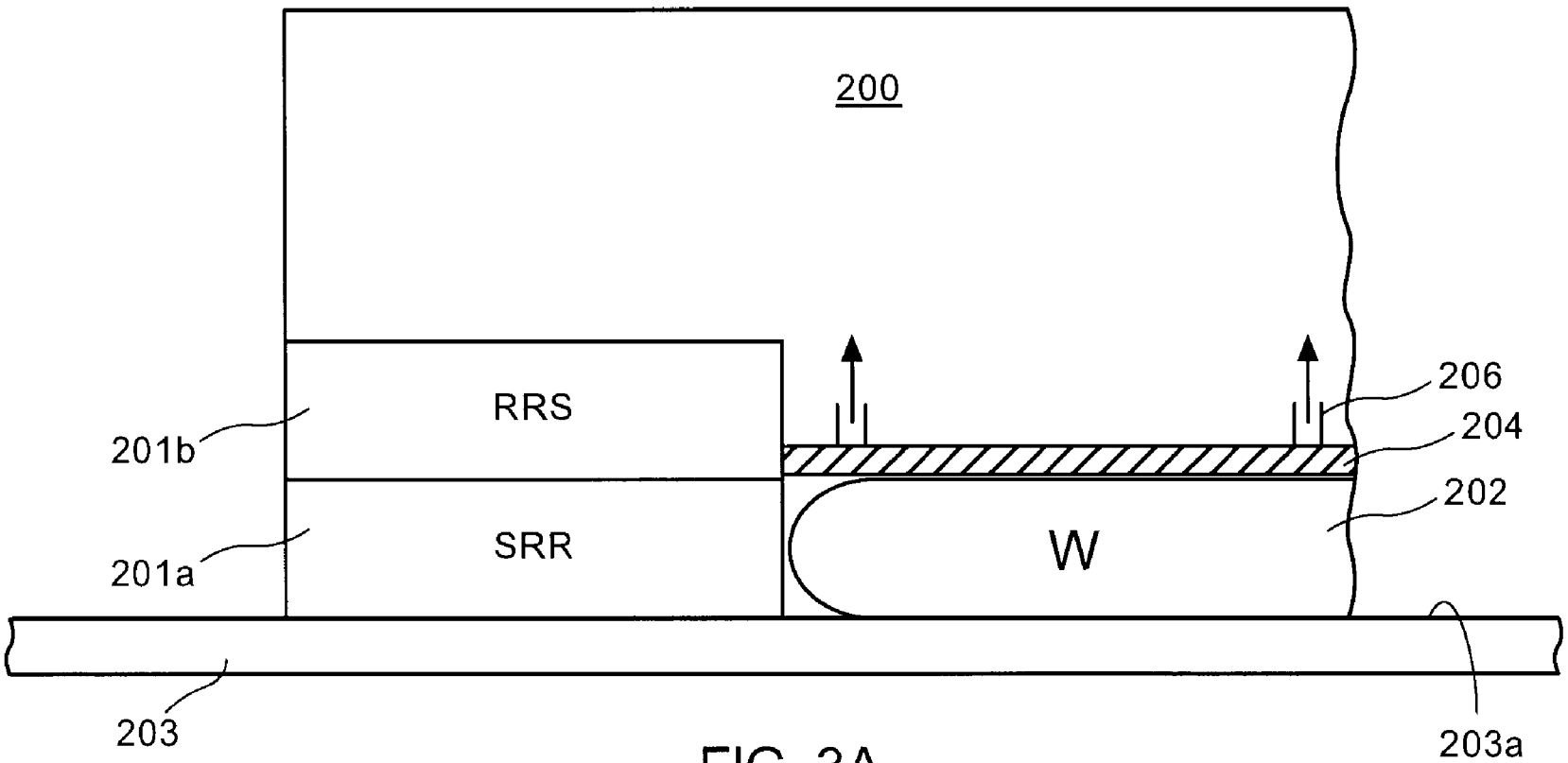
FIG. 3A is an exploded cross-sectional view of a CMP carrier head engaging a retaining ring support holding a sacrificial retaining ring, in accordance with another embodiment of the present invention.

FIG. 3A is an exploded cross-sectional view of a CMP carrier head 200 engaging a retaining ring support (RRS) 201b holding a sacrificial retaining ring (SRR) 201*a*. Also shown are a plurality of vacuums 206 feed through in a carrier film 204 engaging a wafer 202. The surface of the carrier film 204 may include approximately about 4 to 12 vacuum holes 206. The vacuums 206 are configured to retain the wafer 202 via carrier film 204, when the carrier head 200 is no longer in contact with the surface of the polishing pad 103*a*. As depicted, the top surface of the wafer 202 as well as the contact surface of the SRR 201*a* are being applied to a polishing pad surface 203*a* of a polishing pad 203. Specifically shown is the planer relationship of the top surface of the wafer 202 and the contact surface of the SRR 201*a*, revealing the active sacrificial characteristic of the SRR 201*a*.

In one preferred implementation, the SRR 201*a* is constructed from materials having similar characteristics to those of the material of the substrate being polished. Thus, in this embodiment, as it is the silicon wafer 202 that is being polished, the SRR 201*a* is constructed from a material having similar characteristics as silicon (Si) or the films that are typically present on the surface of the wafer 202 (i.e., glass, dielectrics, metals, etc.). More specifically, the chosen material is preferred to be of a material, which friction with the polishing pad surface 203*a* does not introduce any additional defects or contamination to the polishing interface of the SRR 201*a* and the wafer 202. Accordingly, the concurrent polishing of the glass SRR 201*a* and the wafer 202 relocates the line of contact of the polishing interface and the polishing pad surface 203*a* outside of the wafer 202 and to the edge of the glass SRR 201*a* so as to eliminate the aforementioned shortcomings of edge-effects, edge burn-off effects, and pad rebound effects.

Figures 1, 3B:
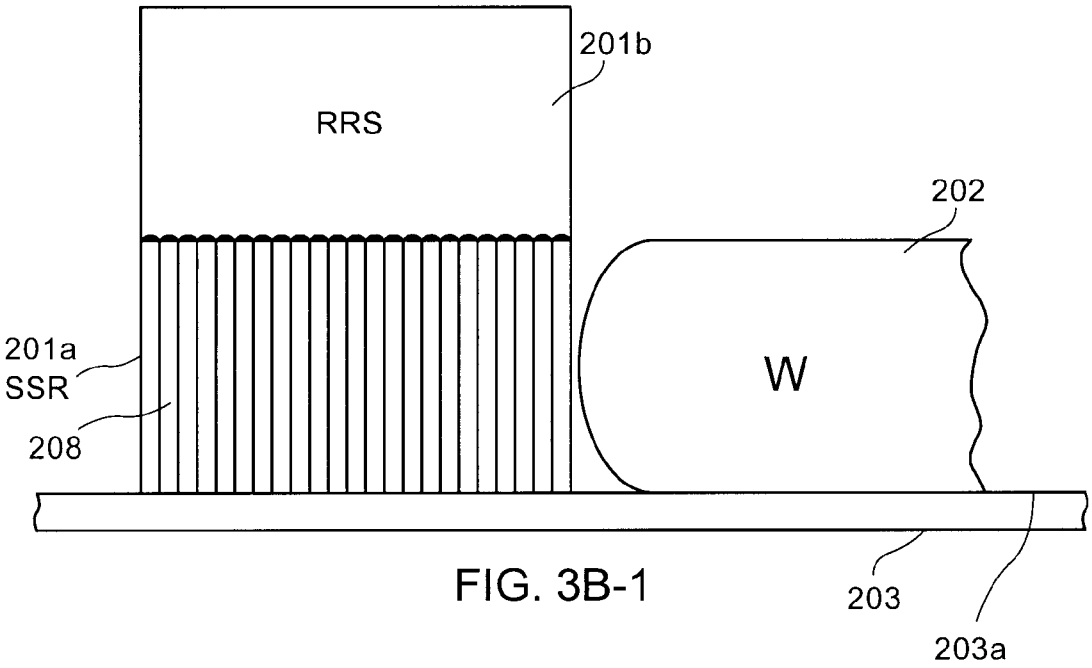
FIG. 3B-1 is an enlarged cross-sectional view of a polishing pad surface being applied to a wafer and a sacrificial retaining ring without introducing additional slurry, in accordance with yet another embodiment of the present invention.
Figures 2, 3B:
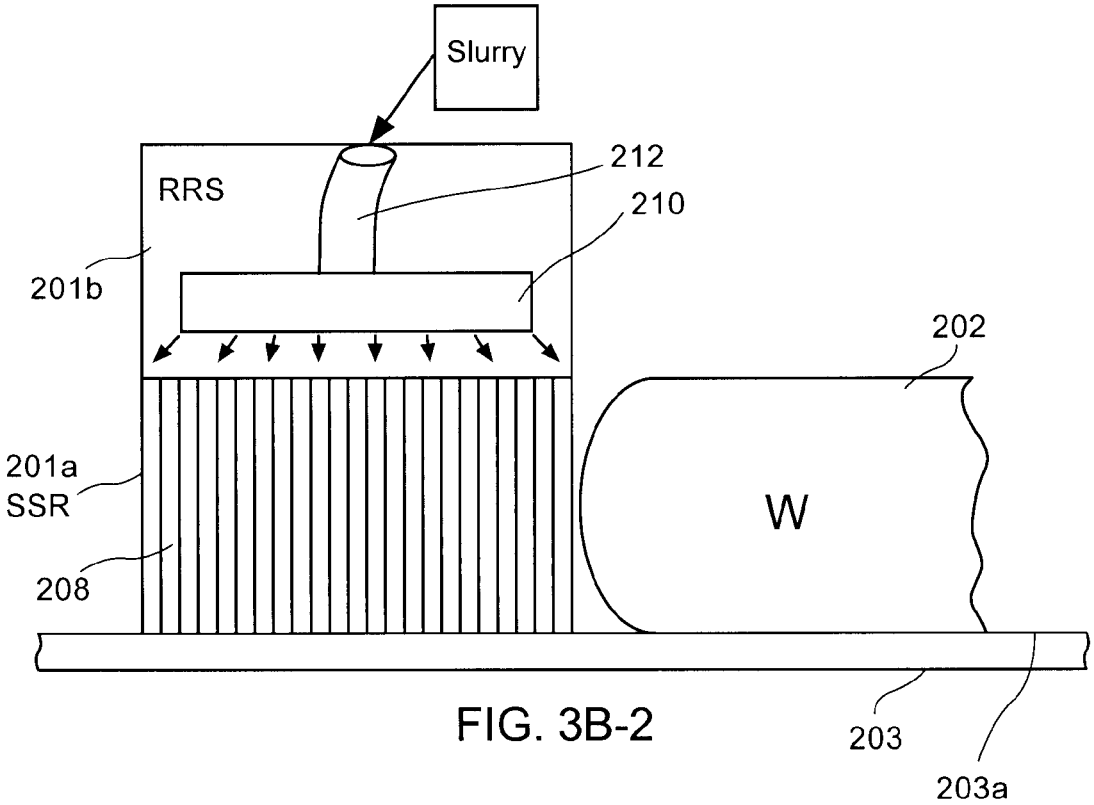

FIG. 3B-1 is an enlarged cross-sectional view of a polishing pad surface 203*a* being applied to a top surface of a wafer 202 and a top surface of a sacrificial retaining ring (SRR) 201*a* without introducing slurry through capillary tubes 208 of capillary tube array units 201*a* 40 (e.g., through collimated hole structures). As depicted, the top surface of the wafer 202 and the contact surface of the sacrificial retaining ring 201*a* are positioned substantially on a same horizontal plane so that the sacrificial retaining ring 201*a* can be polished together with the wafer 202. As shown, the SRR 201*a* contains a plurality of capillary tubes 208, which in this embodiment, extend from the contact surface of the SRR 201*a* to a bottom surface of the SRR 201*a*. The capillary tubes 208 are configured to simulate the pattern of the surface of the substrate being polished (i.e., the wafer 202). Preferably, the diameters of the capillary tubes 208 may vary so as to simulate different types of patterned surfaces of the wafer 202 or different processes so that optimum polishing performance can be achieved.

In the embodiment of FIG. 3B-2 slurry is supplied to a slurry distribution manifold 210 through a slurry guide inlet 212 and is subsequently provided to a sacrificial retaining ring 201*a*. It must be appreciated that although in this embodiment only one slurry guide inlet 212 is depicted, any number of slurry guide inlets 212 may be utilized to introduce slurry to the CMP system. Furthermore, the slurry guide inlets 212 may be made from any material and be in any shape or form (i.e., tubes, channels, etc.).

In one implementation, initially, slurry is supplied to the slurry distribution manifold 210 via a slurry guide inlet 212. Thereafter, slurry distribution manifold 210 provides slurry to the capillary tubes 208 substantially evenly, which in turn, guide slurry to the polishing interface. As a result, slurry usage is minimized by uniformly injecting sufficient quantity of slurry into the polishing pad surface 203*a* at the point of use. Consequently, the polishing pad surface 203*a* is saturated with slurry. Thus, as the polishing pad surface 203*a* moves across the wafer 202, sufficient quantity of slurry will be present at the edge of the wafer 202, the center of the wafer 202, and the low-pressure regions.

The significance of the capillary tubes 208 in facilitating the saturation of the polishing pad 203 with slurry becomes apparent at the instances when the polishing pad surface 203*a* is polishing the center of the wafer 202. Conventionally, due to insufficient presence of slurry at the center of the wafer 202, the removal rate of materials may decrease as the polishing pad surface 203*a* moves away from the edge of the wafer 202 and approaches the center of the wafer 202. However, in this embodiment, the SRR 201*a* saturates the polishing pad surface 203*a* by uniformly distributing slurry to the polishing pad surface 203*a*. As such, while the surface of the polishing pad 203*a* approaches the center of the wafer 202, the polishing pad surface 203*a* contains substantially sufficient quantity of slurry so that the removal rate remains substantially flat from the edge of the wafer 202 to the center of the wafer 202.

Figure 4A:
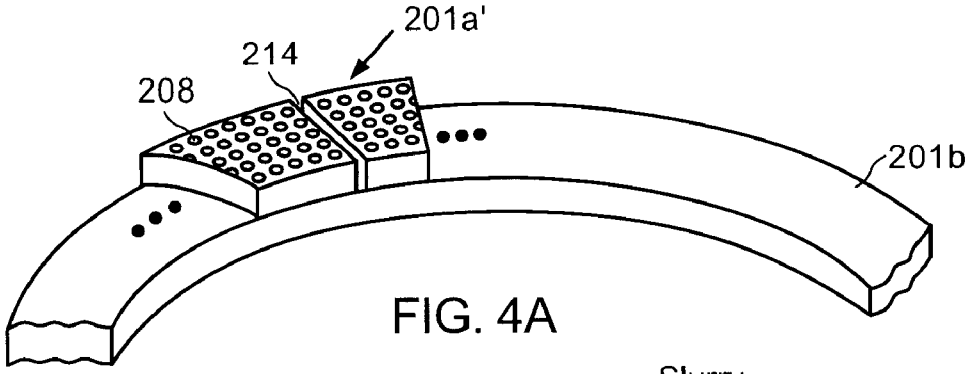
FIG. 4A depicts the structure of a retaining ring and the relative position of a sacrificial retaining ring with respect to the retaining ring support, in accordance with et another embodiment of the present invention.

The structure of a retaining ring 201 and the relative position of a sacrificial retaining ring 201*a* with respect to the retaining ring support 201*b* is shown in FIG. 4A. As depicted, the retaining ring support 201*b* is a contiguous ring which diameter is substantially equivalent to the diameter of the wafer 202. In one embodiment, the retaining ring support 201*b* can be constructed from metal (i.e., Stainless Steal, Aluminum, or any other kind of alloy) or plastic. The retaining ring support 201*b* is configured to support the sacrificial retaining ring 201*a*, which consists of a plurality of capillary tube array units 201*a*'. Although in this embodiment, the sacrificial retaining ring 201*a* is configured to be constructed from a plurality of capillary tube array units 201*a*', it should be appreciated that similar to the retaining ring support 201*b*, the sacrificial retaining ring 201*a* may be a contiguous ring. However, in this embodiment, in an attempt to simplify manufacturability, a plurality of capillary tube array units 201*a*' have been utilized. Exemplary structures, such as capillary tube array units 201*a*', can be custom ordered from Collimated Holes, Inc., of Campbell, Calif.

In one preferred implementation, the capillary tube array units 201*a*' are configured to be placed on top of the retaining ring support 201*b*. The capillary tube array units 201*a*' are placed on top of the RRS 201*b* and adjacent to one another so as to ideally create a ring substantially in the size of the wafer 202. The capillary tube array units 201*a*' may be placed adjacent to one another in a manner so as to create an empty slot 214. Alternatively, the capillary tube array units 201*a*' may be placed next to one another so that no space exists between the two adjacent capillary tube array units 201*a*'. In a preferred embodiment, each capillary tube array unit 201*a*' contains a plurality of capillary tubes 208 and is constructed from a material which has similar characteristic to those of the wafer 202 (i.e., Silicon) or the films typically present on the wafer 202. Most importantly, the capillary tube array units 201*a*' should preferably be constructed from a material that will not contaminate or introduce additional defects to the surface of the post-CMP wafer 202. Thus, the capillary tube array units containing capillary tubes 208 are configured to simulate the patterned surface of the wafer 202 so as to extend the negative effects of the edge effects, edge burn-off effects, and pad rebound effects out of the surface of the wafer 202, thereby achieving a less than a 3-millimeter wafer edge exclusion.

Figure 4B:
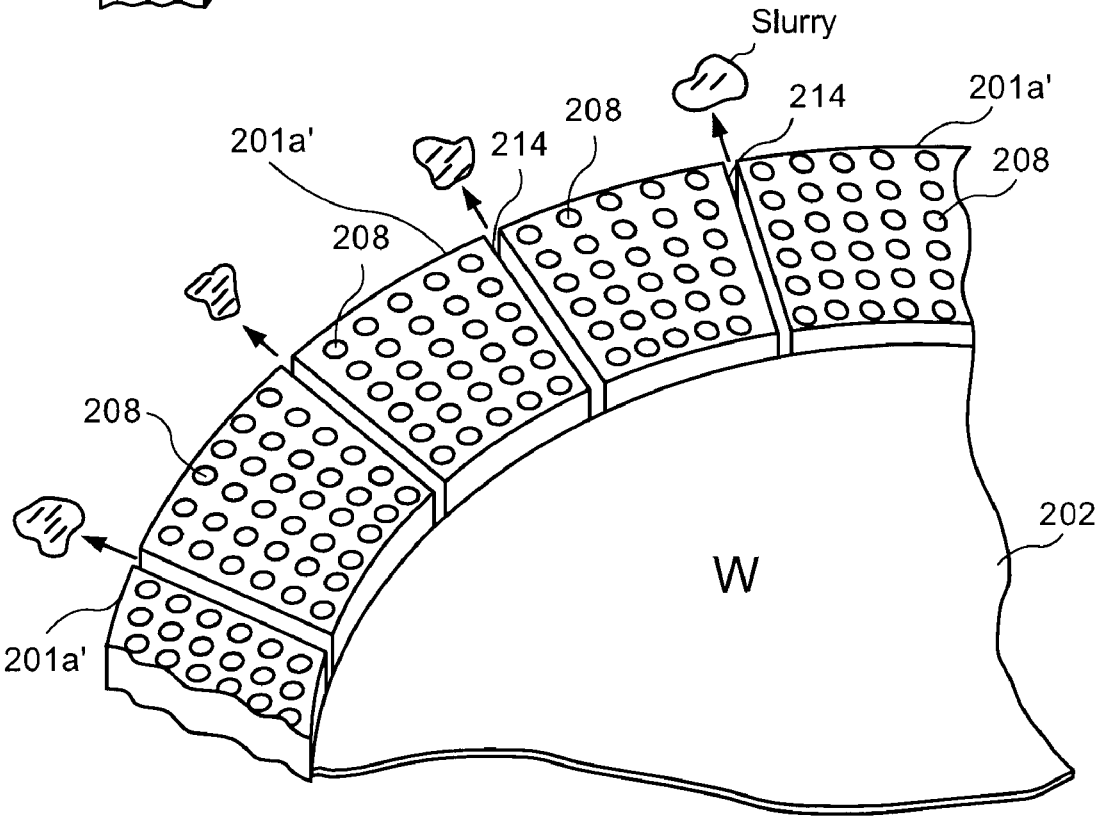
FIG. 4B depicts the relative positions of multiple capillary tube array units with respect to each other as well as a wafer, in accordance with yet another embodiment of the present invention.

The three-dimensional FIG. 4B depicts the relative positions of multiple capillary tube array units 201*a*' with respect to each other as well as a wafer 202. In this embodiment, the capillary tube array units 201*a*' are configured to be placed adjacent to each other in a manner so as to leave an empty space defined as a slot 214. In a preferred implementation, slurry can be supplied to the polishing interface via the capillary tubes 208 as well as the slots 214 thus ensuring the presence of sufficient uniform quantity of slurry through out the surface of the wafer 202.

Figure 4C:
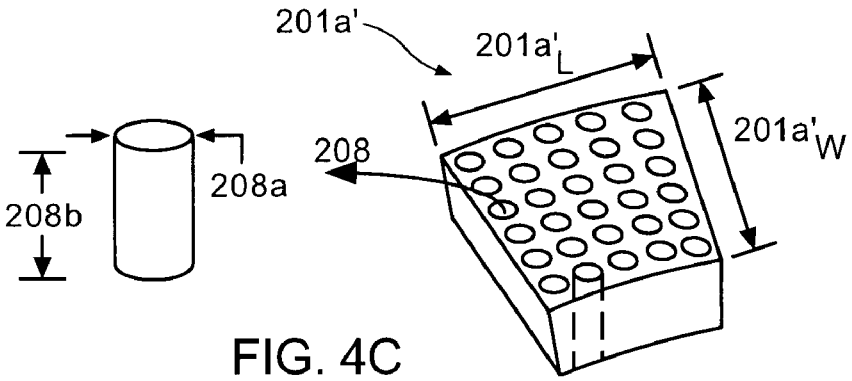
FIG. 4C is a three-dimensional view of a capillary tube array unit, in accordance with yet another embodiment of the present invention.

The three-dimensional view of a capillary tube array unit 201*a*' is depicted in FIG. 4C. As shown, a capillary array unit length $\mathbf{201}a'_L$ of the capillary tube array unit 201*a*' is configured to have an approximate linear range of about 4 millimeters to about 37 millimeters, and a preferred linear length of about 12 millimeters. Similarly, a capillary tube array unit width $\mathbf{201}a'_w$ of the capillary tube array unit 201*a*' is configured to have an approximate range of about 4 millimeters to about 37 millimeters, and a preferred width of about 12 millimeters. As illustrated, the capillary tubes 208 (e.g., holes) cover about fifty percent (50%) of a top surface of a capillary tube array unit 201*a*'. The approximate capillary tube diameter 208*a* of the capillary tube 208 ranges from about 10 micrometers to about 200 micrometers. The preferred inside diameter of the capillary tube 208 is preferably 50 micrometers. Likewise, a capillary tube height 208*b* approximately ranges millimeters, and a preferred capillary tube height 208*b* of about 6 millimeters. However, it should be appreciated that the diameter size and the height of the capillary tube 208 may vary depending on each particular process so that optimum polishing operation is achieved.

Figure 5A:
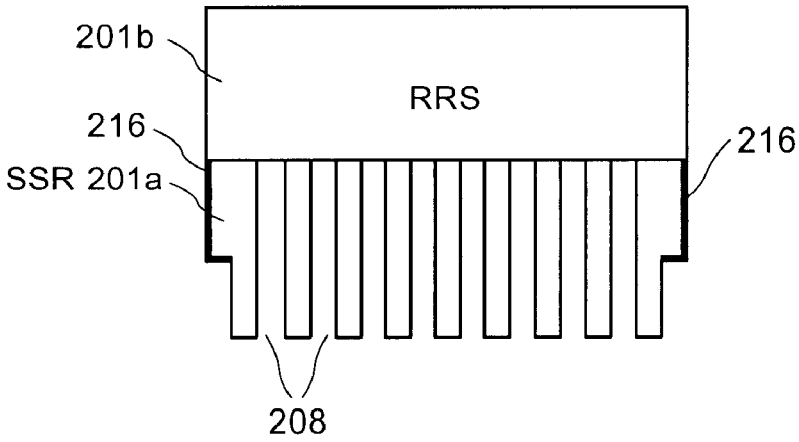
FIG. 5A depicts the retaining ring support holding the capillary tube array units utilizing a contiguous ring finger, in accordance with yet another embodiment of the present invention.
Figure 5B:
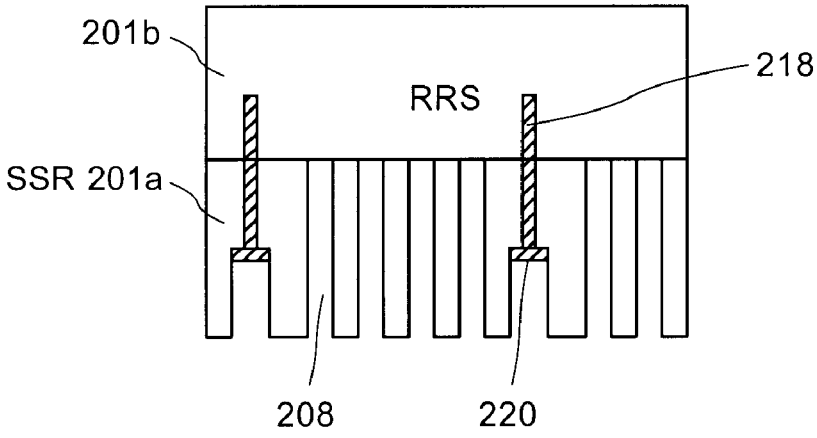
FIG. 5B depicts the sacrificial retaining ring being mounted on the retaining ring support utilizing microscrews, in accordance with yet another embodiment of the present invention.
Figure 5C:
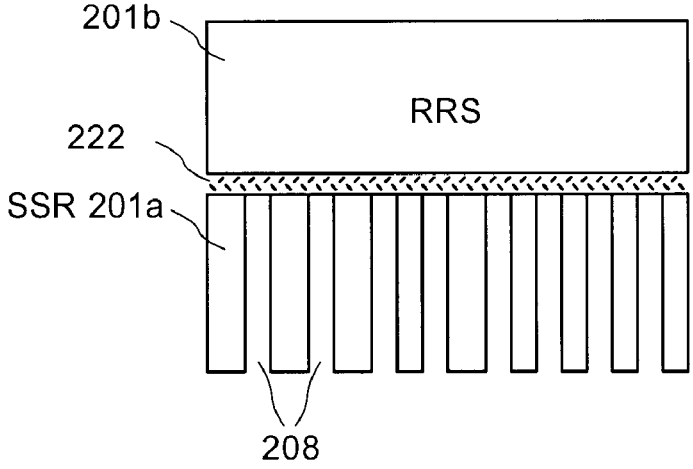
FIG. 5C depicts a sacrificial retaining ring being affixed to a retaining ring support utilizing glue, in accordance with yet another embodiment of the present invention.

FIG. 5A is an illustration of one of several different mounting methods that can be used to place the sacrificial retaining ring 201*a* on the retaining ring support 201*b*. As shown, the retaining ring support 201*b* secures all the individual capillary tube array units 201*a*' together utilizing a contiguous ring finger 216. In the embodiment of FIG. 5B, a sacrificial retaining ring 201*a* is held down to a retaining ring support 201*b* utilizing a fastener (e.g., a microscrews). Alternatively, in a different implementation, as depicted in FIG. 5C, a sacrificial retaining ring 201*a* is affixed to a retaining ring support 201*b* utilizing an adhesive substance (e.g., Epoxy glue).

Although the foregoing invention has been described in some detail for purposes of clarity of understanding, it will be apparent that certain changes and modifications may be practiced within the scope of the appended claims. For instance, the embodiments are applicable to any substrate, such as, storage media disks, semiconductor wafers (e.g., 200 mm wafers, 300 mm wafers, etc.), and any other type of substrate requiring polishing, planarization, buffing, or other suitable preparation operations. Accordingly, the present embodiments are to be considered as illustrative and not restrictive, and the invention is not to be limited to the details given herein, but may be modified within the scope and equivalents of the appended claims.

What is claimed is:

1. A carrier head having a retaining ring structure, the carrier head being configured for use in a chemical mechanical polishing system (CMP), comprising:

a retaining ring support; and a sacrificial retaining ring being configured to confine a substrate to be polished, the sacrificial retaining ring having an upper surface and a contact surface, wherein the upper surface is configured to be attached to the retaining ring support, such that the retaining ring support holds the sacrificial retaining ring, and wherein the contact surface of the sacrificial retaining ring configured to simulate a pattern of the top surface of the substrate being polished is configured to be substantially planer with the top surface of the substrate being polished.

2. A carrier head having a retaining ring structure as recited in claim 1, wherein the contact surface of the sacrificial retaining ring is polished at substantially about the same time as the top surface of the substrate.

3. A carrier head having a retaining ring structure as recited in claim 1, wherein the sacrificial retaining ring includes a plurality of capillary tube array units, each of the capillary tube array units having an upper surface and a contact surface.

4. A carrier head having a retaining ring structure as recited in claim 3, wherein each of the capillary tube array units has a plurality of capillary tubes extending from the upper surface of each capillary tube array unit to the contact surface of each capillary tube array unit.

5. A carrier head having a retaining ring structure as recited in claim 4, wherein the contact surface of each of the capillary tube array units is configured to simulate the pattern of the top surface of the substrate being polished.

6. A carrier head having a retaining ring structure as recited in claim 3, wherein each capillary tube array unit is defined from a material having substantially the same characteristics as a material defining the top surface of the substrate being polished, such that the polishing of the capillary tube array unit is configured to prevent introduction of one of contaminants and particles to the top surface of the substrate being polished.

7. A carrier head having a retaining ring structure as recited in claim 3, wherein each capillary tube array unit is defined from glass.

8. A carrier head having a retaining ring structure as recited in claim 3, wherein each capillary tube array unit has a linear length ranging between about 4 millimeters to about 37 millimeters.

9. A carrier head having a retaining ring structure as recited in claim 3, wherein a linear length of each capillary tube array unit is about 12 millimeters.

10. A carrier head having a retaining ring structure as recited in claim 3, wherein each capillary tube array unit has a width ranging between about 4 millimeters to about 37 millimeters.

11. A carrier head having a retaining ring structure as recited in claim 3, wherein a width of each capillary tube array unit is about 12 millimeters.

12. A carrier head having a retaining ring structure as recited in claim 4, wherein each capillary tube has an inner diameter ranging between about 10 micrometers to about 200 micrometers.

13. A carrier head having a retaining ring structure as recited in claim 4, wherein an inner diameter of each capillary tube is about 50 micrometers.

14. A carrier head having a retaining ring structure as recited in claim 4, wherein each capillary tube has a height between about 1 millimeter to about 25 millimeters.

15. A carrier head having a retaining ring structure as recited in claim 4, wherein a height of each capillary tube is about 6 millimeters.

16. A carrier head having a retaining ring structure as recited in claim 1, wherein the retaining ring support includes a slurry distribution manifold having a slurry guide inlet, such that slurry is configured to be supplied to the slurry distribution manifold via the slurry guide inlet so that slurry can be substantially uniformly distributed to the contact surface of the sacrificial retaining ring.

17. A carrier head having a retaining ring structure as recited in claim 1, wherein the retaining ring support is configured to retain the sacrificial retaining ring.

18. A carrier head having a retaining ring structure as recited in claim 17, wherein the retaining is facilitated using one of a screw, ring finger, and glue.

19. A wafer holding and application apparatus for use in chemical mechanical polishing (CMP) applications, the apparatus comprising:

a carrier head;

a retaining ring support being attached to the carrier head;

a sacrificial retaining ring being attached to the retaining ring support, the sacrificial retaining ring being configured to confine a wafer at a desired location when applied to a polishing surface by the carrier head, the sacrificial retaining ring being defined from a material that approximates the wafer, and a contact surface of the sacrificial retaining ring configured to simulate a pattern of a to be polished surface of the wafer being positioned approximately planar with the to be polished surface of the wafer.

20. A wafer holding and application apparatus as recited in claim 19, wherein the sacrificial retaining ring includes a plurality of capillary tube array units, each of the plurality of capillary tube array units having a plurality of capillary tubes extending from the retaining ring support to the contact surface of the sacrificial retaining ring.

21. A wafer holding and application apparatus as recited in claim 19, wherein the contact surface of the sacrificial retaining ring is polished at substantially about the same time as the to be polished surface of the wafer.

22. A wafer holding and application apparatus as recited in claim 20, wherein the retaining ring support is configured to include a slurry distribution manifold having a slurry guide inlet, such that slurry is supplied to the slurry guide manifold via slurry guide inlet to the plurality of capillary tubes, thereby distributing slurry substantially uniformly to the contact surface of the sacrificial retaining ring.

23. A wafer holding and application apparatus as recited in claim 19, wherein the sacrificial retaining ring is attached to the retaining ring support utilizing one of a screw, ring finger, and glue.

24. A method for making a carrier head to be used in chemical mechanical polishing (CMP) a wafer, comprising:

generating a retaining ring support;

attaching the retaining ring support to the carrier head;

generating a plurality of capillary tube array units;

attaching each of the plurality of capillary tube array units around the retaining ring support, each of the plurality of capillary tube array units having a contact surface, the plurality of capillary tube array units defining a sacrificial retaining ring that is configured to contain the wafer having a surface to be polished, the surface to be polished and the contact surface of each of the plurality of capillary tube array units being defined at about a same planar position, wherein the contact surface of each capillary tube array unit is configured to simulate the surface of the substrate being polished.

25. A method for making a carrier head as recited in claim 24, further comprising:

generating a plurality of capillary tubes on each of the capillary tube array units such that each of the capillary tubes extends from the contact surface of each of the capillary tube array units to the retaining ring support.

26. A method for making a carrier head as recited in claim 25, further comprising:

generating a slurry distribution manifold in the retaining ring support for introducing slurry to the contact surface of the sacrificial retaining ring substantially uniformly utilizing the capillary tubes.

27. A method for making a carrier head as recited in claim 24, wherein each of the plurality of capillary tube array units is attached around the retaining ring support utilizing one of clamping, gluing, and screwing.

28. A carrier head having a retaining ring structure, the carrier head being configured for use in a chemical mechanical polishing system (CMP), comprising:

a retaining ring support; and a sacrificial retaining ring having an upper surface and a contact surface, the sacrificial retaining ring defined from a material having substantially the same characteristics as a material defining a top surface of a substrate being polished, wherein the upper surface is configured to be attached to the retaining ring support, such that the retaining ring support holds the sacrificial retaining ring, and wherein the contact surface of the sacrificial retaining ring configured to simulate a pattern of a top surface of the substrate being polished is configured to be substantially planer with the top surface of the substrate being polished.

* * * * *